United States Patent [19]

Sheeran et al.

[11] Patent Number: 4,780,156

[45] Date of Patent: Oct. 25, 1988

[54] WATER RESISTANT SENSITIZING ADDITIVE FOR AMMONIUM NITRATE BLASTING AGENTS

[76] Inventors: Harold W. Sheeran; John P. Sheeran, both of Rte. 4, Box 478, Cheney, Wash.

[21] Appl. No.: 915,510

[22] Filed: Oct. 6, 1986

[51] Int. Cl.[4] ..... C06B 45/02

[52] U.S. Cl. ..... 149/21; 149/2; 149/41; 149/61; 149/72

[58] Field of Search ..... 149/2, 41, 61, 72, 21

[56] References Cited

U.S. PATENT DOCUMENTS

| | | | |
|---|---|---|---|
| 3,465,675 | 9/1969 | Bronstein, Jr. | 149/21 |
| 3,540,953 | 11/1970 | Schultze | 149/21 |
| 4,039,361 | 8/1977 | Ray et al. | 149/21 |
| 4,128,442 | 12/1978 | Barlow | 149/21 |
| 4,198,253 | 4/1980 | Kirchnerova et al. | 149/44 |
| 4,207,125 | 6/1980 | Grant | 149/44 |
| 4,637,849 | 1/1987 | Harris | 149/43 |

*Primary Examiner*—Stephen J. Lechert, Jr.

*Attorney, Agent, or Firm*—Keith S. Bergman

[57] ABSTRACT

A dry non-explosive additive for ammonium nitrate-fuel oil (ANFO) blasting agents which provides water resistance and wet sensitivity to allow use of the explosive in wet drill holes. The additive contains gelling agents that rapidly hydrate and swell upon water impingement, and thereafter cross-link to rapidly form a peripheral water-blocking barrier to prevent further water intrusion into a loaded blasting agent mass. The additive additionally contains hydrophobic sensitizers and optional fuels to provide points of adiabatic compression and physically hinder water incursion. When the additive is mixed with ANFO, the resulting blasting agent retains its dry and free pouring characteristics and has enhanced explosive properties over untreated ANFO. While ANFO may not detonate in wet conditions unless protected from water, when admixed with our additive it retains its explosive characteristics and detonation potential after placement in wet environs, to function well either wet or dry.

14 Claims, No Drawings

WATER RESISTANT SENSITIZING ADDITIVE FOR AMMONIUM NITRATE BLASTING AGENTS

BACKGROUND OF INVENTION

A. Related Applications

There are no applications related hereto heretofore filed in this or any foreign country.

B. Field of Invention

Our invention relates generally to ammonium nitrate-fuel oil (ANFO) blasting agents and more particularly to an additive for such agents that provides gelling materials, energy and sensitivity additives and dry fuels to form water impervious, explosive, peripheral gells upon water impingement.

C. Background and Prior Art

Ammonium nitrate explosive mixtures have been known since the time of Nobel, and since that time have evolved through various stages. Initially they were combined with primary explosives such as nitro-glycerin in dynamite formulations, where the ammonium nitrate served primarily as an active oxidizing agent. The ammonium nitrate used was a crystalline product of graining kettles. Such mixtures were known as ammonia dynamites and in these applications, the blasting strength of the mixture was about 70 percent of that of the contained nitro-glycerin. These ammonia dynamites had little water resistance but, because of their lower cost, lower velocities of detonation and higher gas yield, could be used in dry conditions, with both cost savings and blasting advantages. In the 1930's, the water resistance of such compositions was somewhat improved by the addition of cold water soluble gums, such as guar gum and locust bean gum.

After the Second World War, when porous ammonium nitrate prills first became available to industry from war surplus plants, it was soon discovered that the addition of dry or liquid carbonaceous fuels made the ammonium nitrate into an economical, safe and effective blasting agent. This class of blasting agent required dynamite to initiate detonation, as the material was not sensitive to a blasting cap like other explosives, and was inherently safer. The material has since become the most widely used explosive in modern day commerce. The explosive commonly is called "ANFO" and that term is herein used to refer to such compounds. The primary drawback of this material is that it has very little water resistance and is difficult or impossible to use in wet environs.

In practice ANFO is made by mixing about 6 percent of diesel fuel oil with about 94 percent of porous ammonium nitrate prill, to give substantial oxygen balance and optimum performance. This mixture of ANFO performs comparably to 50 percent gelatin dynamite in rock blasting. The low cost, higher gas yield, safety of storage and ease of loading, have all contributed to wide acceptance of this material in blasting. ANFO, however, is soluble to the extent of 118 gms/100 ml of water at 0 degrees C., to 871 gms/100 ml of water at 100 degrees C. This high solubility in water has prevented direct use of ANFO in wet drill hole conditions to this day, as even as little as 6 percent water by weight will cause an ANFO column to fail to detonate. Various methods of overcoming this deficiency have been tried over the years, such as the addition of guar flours and other water thickening products, higher viscosity oils and greases as fuels to coat the prills, encapsulation of the prills in waxes and the like, but largely with no particular degree of success or acceptance by explosive users. Perhaps the most successful water-proofing method heretofore developed has been "sleeving", wherein a drill hole is pumped free of water, a double polyethylene sleeve is placed in the hole, weighted down by a primer stick of dynamite, and loaded with ANFO before water can return in the hole. This method has found some degree of acceptance, but a tear in the plastic sleeve is a common hazard and often results in failed detonation.

Parallel to the development of ANFO, it was found that ammonium nitrate in a saturated aqueous solution, with the proper sensitizers, gel structure and density controllers, could be detonated satisfactorily in wet conditions. A sophisticated technology of slurries, water gels and emulsions developed around this finding. Slurries with explosive sensitizers were classed as explosives, and those with non-explosive sensitizers were classed as blasting agents. Sensitized aqueous ammonium nitrate compositions were invariably in the form of gels, with viscosity controlled to suit the use and at the same time maintaining a uniform and stable suspension of sensitizers. While free flowing dry ANFO compositions have a density of about 0.85 gms/cc, gelled slurries have densities in the range from 1.20 to 1.55 gms/cc, depending on formulation and amount of entrained air. The density of all slurries is heavier than water so they will sink in water filled holes. Most slurries, water gels and emulsions perform comparably in blasting to fully coupled ANFO columnar loads, on a volume for volume basis, and will out perform cartridged ANFO loads.

Because of the added weight required and higher (per pound) costs of slurries, considerable effort has been extended to develop methods to keep ANFO dry to allow its use in wet bore hole conditions. Polyethylene bags have been found marginally suitable for this, either in the form of individual cartridge bags with a tear resistant outer covering, or double walled bags with water proof seals. These later bags have been produced for example in 5 inch×30 pounds or 8 inch×50 pound sizes, and if a blasting composition used in them were not modified to obtain a sinking density, drill holes in which they were used had to be pumped free of water before lowering the cartridges. Even though these polyethylene bags were double walled, they had to be handled and loaded carefully because a minor puncture or tear would allow entry of water and might cause a bore hole to fail to propogate an explosion. Such bagged material when stacked in a drill hole needs multiple primers spaced up the column, and is never fully coupled to the walls of the drill hole, causing less than optimum performance. These cartridging methods, however, are still quite widely used with ANFO blasting agents in wet environs in 4 inch and larger diameter drill holes.

Slurries followed a parallel development in the use of plastic cartridges. Because of their inherent water resistance and density, however, they could be poured or pumped into water filled drill holes without a plastic liner or cartridges. In this way, as a slurry was pumped into a wet drill hole, being heavier than water, the water was displaced upwardly resulting in a drill hole loaded solid in its bottom part with product, similarly to ANFO poured into a dry hole. With both the cartridged ANFO and cartridged slurries, there is a significant increase in cost of both the product and priming, the former because of the added packaging costs, and the latter, because stacked cartridges require multiple primers to insure reliable detonation. A further disadvantage was that bore holes are not completely filled by the cartridges and there is therefore a significant loss of performance because of lack of complete explosive column coupling in a bore hole.

There is presently no intermediate alternative product between the economical dry, free flowing ANFO blasting agents and the more expensive slurries. Our present invention provides a new and novel composition that effectively fills this gap.

SUMMARY OF INVENTION

Our invention provides a non-explosive, self-extinguishing mixture in the form of a dry additive, which can be mixed with traditional ANFO, either in plant or in the field, to impart water resistance and enhances other properties of an ANFO blasting agent. The additive has physical characteristics much like dry wheat flour, and can be variously formulated to add strength, velocity, wet sensitivity and oxygen balance to ANFO, in addition to water resistance. When our additive is mixed with ANFO, the finished products provide a family of blasting agents with predictable properties that vary through predeterminable ranges.

Our additive contains finely particulated gelling and cross-linking agents, hydrophobic energy adding sensitizers, and may contain solid fuels and inert hydrophobic solids, all in the form of thoroughly mixed dry powders. In all formulations, the gelling and cross-linking agents react rapidly with water impinging on the material, to form a water resistant gel about the peripheral area of water impingement. The sensitizers insure that wet and gelled areas will detonate reliably. The hydrophobic dry particulate constituents serve in part to block water entry in the interstitial spaces between the ammonium nitrate prills, and at the same time, hold air bubbles on their surfaces in wetted areas to form compression centers enhancing propogation. The blasting material resulting from mixture of our product and ANFO has substantially the same handling characteristics as the parent ANFO blasting agent, but in addition has water resistance, enhanced sensitivity and other advantages.

In creating such an additive, it is:

A principal object of our invention to provide a dry free-flowing additive for ANFO blasting agents that allows such agents to be used in wet environs and yet retain their blasting and detonation properties for long periods of time after loading in wet bore holes.

A further object of our invention to provide such an admixed blasting agent with relatively highly cross-linked gelling agents that are activated by water during and after loading in the drill hole, to rapidly form a highly gelled peripheral area in a blasting agent, adjacent to the area of water impingement, which gelled area is relatively impervious to further water absorption and transmission for substantial periods of time, and at the same time will detonate reliably.

A further object of our invention to form such blasting agents with prilled ammonium nitrate and more finely particulated hydrophobic and other materials that partially fill voids between prill particles to thereby aid in preventing the passage of water through such interstices.

A further object of our invention to provide such a premixed additive that is fully compatible with ANFO blasting agents already containing normal additives heretofore used, such as sodium nitrate and calcium nitrate, and one which permits their use in substantially the same fashion, for substantially the same purposes, and without diminishing the results of their use, while at the same time contributing water resistance, added energy, and wet sensitivity to the modified ANFO.

A still further object of our invention to provide additives for ANFO and modified ANFO's that may be manufactured as a separate additive premix, which is precisely formulated, physically stable, non-explosive, self-extinguishing when ignited, transportable by common freight, and may be readily and safely admixed by a simple processing in plant or in the field, to produce a blasting agent having predictable and reliable performance.

Other and further objects of our invention will appear from the following specification and claims. In carrying out the objects of our invention, however, it is to be understood that its essential features are susceptible of change and modification of both materials and processes, with only preferred and practical embodiments being illustrated in the included examples as is required.

DESCRIPTION OF PREFERRED EMBODIMENT

Our invention provides a new and novel method of creating water resistance and wet sensitivity in dry ANFO blasting agent compositions, which can extend the practical use of such compositions to many wet environs where formerly only more costly slurries, water gels, emulsions, water resistant packaged products, and dynamites could be used. Essentially, it fills an existing gap between the cheaper ANFO and the more expensive highly water resistant products.

It has been discovered that sufficient amounts of dry, finely milled guar gum flour, carried on the exterior surfaces and within the interstices of ammonium nitrate prills, will inhibit and stop water penetration into a column or mass of ANFO based blasting agent, especially as in an explosive column defined by a drill hole.

Guar gum, polyacrylamides and other similar water thickening agents also are used in the manufacture of commercial hot ammonium nitrate liquor solution based slurries and water gel blasting agents and explosives. When such guar gums and polyacrylamides are used in these formulations, they must be fully hydrated in the aqueous phase before mixing is completed and cross-linking can take place. The completed mix is either packaged in plant, or pumped directly into drill holes, as in the case of on-site pump trucks and repumpable slurries. These products are normally pourable, pumpable or plant packaged gels, and this physical product form is existent prior to use.

Compositions of the instant invention are placed in dry form in dewatered wet drill holes. They have no aqueous phase prior to placement, and indeed, an aqueous phase is neither essential nor necessary to their performance. If an aqueous phase forms incidentally, in part or in total because of incidental impingement of water, the area of gel formation under bore hole confinement will effectively detonate, equally as well as the dry parts of the column.

In compositions made with our invention, ANFO prills are coated with a relatively high amount of finely particulated dry ingredients, including guar gum, cross-linking agents, energy and sensitivity additives, inert additives and dry fuels. A portion of these dry ingredients is maintained in close association with the surface of the ammonium nitrate prills by the liquid fuel used in the ANFO, and the fuel also serves as a binder. The remaining amounts of the additive fills interstitial spaces between prills, after the prills have been coated in mixing. In this manner the additive is partitioned, with a first part coating the prill surfaces, and the remainder filling voids between the prills. The balance in the partitioning is dependent on the size gradation and surface area of the prills as well as the fineness and covering ability of the premix additive chemicals, and will vary somewhat with the nature of a prill and the prill manufacturing process.

Our additive admixed with ANFO pours freely from bags, may be bulk loaded, and may be blow loaded into dewatered or damp holes, but yet on impingement of water at the periphery of a coherent mass of material, the gum there present hydrates rapidly to form a water barrier. We have found that both rapid hydration and maximum uniform distribution of a gum throughout the mix are beneficial. For best results, guar gum, if used, should be of high quality with a minimum of 80 percent galactomannan content, of low moisture content preferably of 12 percent and less, and of a very fine grind such that 85 percent passes a 200 mesh standard sieve screen. The particle size should provide a high percentage of grains of 75 microns or less in major dimension. The high galactomannan and low moisture contents provide maximum solution viscosity, while the fine granulation and high quality guar give rapid hydration, early high viscosity and maximum uniform dissemination of the guar gum throughout the finally mixed blasting agent. Of the many commercial guar gum flours available, both domestic and foreign, those most suitable have been found in 1 percent aqueous solutions, using a Brookfield #3 spindle, to give viscosities of 3500 centapoise and above and to be fully compatible with ammonium nitrate solutions.

A water impervious boundary zone quickly forms in the drill hole environment between wetted and dry areas of our finally mixed blasting compositions. This zone is between ¼ inch to several inches in thickness, depending on the rate of flow and pressure of the impinging water. The boundary has a sharp interface between dry and wet areas, and is physically stable, allowing no admixture or separation of the components and restraining further entry of additional water. This reaction constitutes a very significant difference from reactions of prior art slurries and water gels, which must be produced in sophisticated mixing equipment, using step by step formulation under a precisely controlled time and temperature process. In these latter processes, the guar gum must be completely hydrolyzed in a hot aqueous ammonium nitrate solution prior to the addition of any sensitizers, air entrainment materials and cross-linkers to form the gelled final composition at a closely controlled final temperature and density. Thus it is the preformed gel matrix that gives slurries and water gels their dimensional stability and water resistance.

The processes that inhibit water penetration into our finally mixed blasting composition are entirely different. As water comes into contact with the guar coated ammonium nitrate prills, a gel immediately starts to form as the guar hydrates, as enhanced by the relatively high and localized concentration of the gum. The impinging water thereby becomes increasingly thicker as it flows around the surface of the prills. It continues to absorb more gum to thus increase its viscosity. Within a short period of time, the water becomes less and less mobile, until a thick gel is formed which stops further intrusion of the gelled water into the blasting composition mass, usually forming a sharp interface between the wet and dry areas beyond which no new water can penetrate. The guar flour of the composition that is disposed in the interstices between the prills operates in a similar manner also, and in combination with the gelled surface of the prills, constitutes a barrier zone through which new water must pass, and causes increasing difficulty with water so doing.

As the guar gum has to hydrate before it will cross-link effectively, it was discovered that low solubility cross-linkers of relatively low surface area or cross-linkers inhibited by oil, wax or other suitable coatings, come more slowly into solution in the encroaching water, to thus allow formation of more fully hydrated guar gels and thusly to enhance subsequent cross-linking by making it more rapid and effective. When cross-linked, the gels of the wetted blasting composition form three dimensional bonds which give the gels elastic characteristics and make them tougher and more resilient. These cross-linked gels form a superior and more permanent barrier to further water entry and can withstand normal hydrostatic heads and extended periods of immersion without breaking down. Under very adverse water conditions where ingress of water is rapid, more of the blasting composition column will become wet before the barrier condition is established than would be the case with less water. The blasting composition detonates equally well, however, wet or dry. Cross-linking of the guar gum in our blasting compositions is therefore both an important and novel element of our invention. Without cross-linking the gels formed may be thick but they are weak enough to be diluted by continued active water flow and will soon be diluted to allow further water penetration into a blasting composition. In non-cross-linked gels where water access is greatest, layers of blasting agent will be penetrated, deteriorate and allow separation of the constituents, release of entrained air, and solution of the water soluble components, all of which work against reliable detonation and propogation.

The borate ion is our preferred cross-linker, as it is of low solubility, available in granule sizes best suited for use with our composition, and relatively inexpensive. Aging tests of our dry additive have shown the borate ion to be completely stable, remaining dormant and unreacted for over a year. After our additive is mixed with ANFO, the borate ion is then activated only when it comes in contact with water. We prefer borate ion presence in the form of anhydrous borax, preferably in plus 30 mesh sizes, and to the extent of 0.1 percent to 10 percent by weight of the contained guar flour, depending on the quickness of the cross-linking reaction desired. With this material at optimum level of usage substantial cross-linking takes place in laboratory tests within 5 minutes and the cross-linking continues to cause the gels to become more resilient and tougher for about 30 minutes when they become fully cross-linked.

While we have found guar flours, polyacrylamides and combinations thereof to be most effective in formulations of our additive, other water swellable and water thickening gums and polymers can be used, though generally they require higher concentrations to obtain effective results. These other agents include cold water soluble starches, modified polyacrylonitriles, modified guars, methyl cellulose, ethyl cellulose and carboxymethyl cellulose. Depending on the thickener used, cross-linkers must also be varied. For example the more insoluble chromates, arsenites, potassium antimony tartrate, potassium pyroantimonate, tannic acid, and other selected organic acids may act as cross-linkers, accelerators, or both.

The additive of our invention can not only be used to modify conventional ANFO, but can be used with aluminized ANFO and ANFO enhanced with metal nitrates, such as sodium nitrate and calcium nitrate. These later blasting agents used with our additive are particularly useful in oxygen balanced formulations for blow loading of small drill holes underground in mining and quarrying, where they detonate effectively in 1.25 inch diameter drill holes. The sodium nitrate addition also increases loading density, which with ground ammonium nitrate can easily be formulated to a density of 1.10 gms/cc. Such higher density formulations can be formed into cartridges and will easily sink through water, offering the additional advantage, with use of our additive, of sealing off water if a leak or tear develops in the container. Calcium nitrate may be used for the same purposes, and at the same concentration as sodium nitrate will give a more sensitive product with higher detonation velocity.

Modern blasting practice often requires maximum velocity and strength in ANFO blasting agents, both to allow expansion of a drill pattern to the practical maximum dimensions, and at the same time to maximize rock breakage and fragmentation. The primary reaction of the explosive decomposition of ANFO is shown in the following formula for a fully oxygen balanced ammonium nitrate prill and diesel fuel oil composition.

$$3NH_4NO_3+CH_2X=7H_2O=CO_2=3N_2+870 \text{ Kcal/KG at } 3000^\circ \text{ K.}$$

If water invades the ANFO, it detracts from the heat of reaction, and the remaining heat of reaction may not be sufficient to sustain the detonation. As an example, about 50 Kcal/Kg of reacted ANFO are required to heat and vaporize the moisture in an ANFO mixture containing 8 percent water. This loss of reaction heat is often enough to quench detonation. Depending on drill hole size and confinement, it is generally accepted that from 6 to 9 percent of added water will quench the ANFO detonation and cause a failed hole, as most often evidenced by the presence of orange nitreous oxide gas.

The initiation and propogation of particulate and non-ideal explosions is thermal in nature. This is to say, the sudden application of mechanical energy is transformed into thermal energy in the form of spaced areas of high temperature or 'hot spots' as they are commonly called, in the explosive. For a stable detonation, that is one that continued and self-propogates, the energy flow must be sufficient to maintain the reaction. This is accomplished in blasting agents in three ways: (1) adiabatic heating or the sudden compression of small interstitial air spaces or bubbles in the prill and mixture, transforming shock energy into heat; (2) frictional heating created by the abrupt collision of the mixture ingredients against each other to cause frictional hot spots; and (3) additional frictional heating caused by actual shear and viscous flow, particularly in the more reactive ingredients of the mixture in advance of the detonation front. In ANFO detonation adiabatic heating of the entrained and interstitial air is by far the most significant cause of explosive propogation. The same mechanism is so important to slurry, water gel and emulsion formulations, that they often may incorporate hollow glass or plastic micro-spheres to insure this effect for reliable detonation. Because of this the simple addition of guar gum flour or even self-complexing guars alone to ANFO will not suffice to make an effective water resistant blasting agent. Guar gums limit water penetration into an ANFO mass but they do nothing to improve the sensitivity of the desensitized wet areas of that mass. The wet areas have less sensitivity because of the water quenching discussed, and beyond 6 to 9 percent of water will prevent efficient and reliable detonation.

Compositions of the present invention, in addition to guar gums and cross-linkers contain reactive energy and sensitivity adding fuels and usually also contain solid carbonaceous fuels which are stable and do not migrate or dissolve out, and non-reactive hydrophobic solids such as perlites, microspheres and diatomaceous materials, in addition to the ANFO. All of these materials, acting singularly or together, supply additional heat to the reaction, so that rather than being quenched by encroaching water, a blasting composition has enough additional heat available to detonate reliably and efficiently through water wet sections.

Finely particulated reactive fuels, such as aluminum, aluminum fluoride, sodium aluminum fluroide, magnesium fluoride, ferrosilicon and sulfur, have been found to be very inportant in adding requisite energy to offset the water quenching effect, whereas guar alone adds nothing in this area. Aluminum has been widely used as a sensitizer in slurry formulations containing from 11 percent to well over 20 percent water, because of its significant added heat of reaction. The initial stage of the aluminum reaction oxidizes the metal to ALO in an endothermic reaction, but this is followed by a strongly exothermic oxidative reaction to $AL_2O_3$. Being a solid end product, the $AL_2O_3$ does not add gas volume but it does substantially increase the overall temperature of the reaction to increase overall gas pressure and therefore reaction strength. Sulfur, on the other hand exothermally produces $SO_3$ in the explosive reaction and this hot gas further reacts with water vapor produced in the primary explosive reaction to form gaseous $H_2SO_4$ in a second exothermal reaction. The sulfur therefore produces only gaseous end products and with added heat of formation adds significantly to the overall gas volume and pressure produced. If sodium nitrate is present in the explosive composition an additionally strongly exothermic reaction takes place in the formation of $Na_2SO_4$. Observation of field blast results shows no detectable performance differences between aluminum and sulfur in wet condition. There are good indications that in admixture, the performance is better than with either component alone. The flourides mentioned react strongly in ANFO detonations in a wet environment, particularly in a ratio of 2:1 to sulfur present. $Alf_3$ with sulfur present appears to be somewhat superior to Al alone, at the same concentration and is much less costly as an ingredient. Ferrosilicon performs comparably to Al taken alone in the ANFO formulation but is also enhanced by the present of sulfur. While the preferred sensitivity additives add to either wet sensitivity, energy or both under wet conditions, all but the finest grades of aluminum detract from the dry sensitivity. Prior to loading in a drill hole, and in dry bore hole areas, all are less sensitive than ANFO, but wet, the sensitivity is greatly improved over wet ANFO.

In addition to the water thickening agents and cross-linkers, our compositions contain hydrophobic energy and sensitivity adding fuels, hydrophobic solid carbonaceous fuels, hydrophobic energy additives and non-reactive hydrophobic solids, all of which acting together add wet stability and supply additional heat to the blast reaction so that rather than being quenched by encroaching water, the blasting agent detonates reliably and efficiently through wet areas. In this way, our invention employs the following mechanisms against quenching of the ANFO blast reaction:

(1) The guar gum by its rapid hydration firstly makes entering water thicker and progressively less able to penetrate the blasting composition mass.

(2) Cross-linking of the hydrated guar gum and water solution into a three dimensional elastomeric mass causes the wetted area to act as an impervious barrier to inhibit further water incursion, and also physically stabilized the wet zones of the mass.

(3) The solubility potential of ammonium nitrate prills is greatly reduced by the viscosity and cross-linking of the guar and water gels, so that encroaching water is no longer mobile enough to be an effective solvent.

(4) Entrained air bubbles remain stable in the thickened and cross-linked guar and water gels, and cannot migrate, and thus serve to create potential adiabatic "hot spots" uniformly dispersed to sensitize the wet areas and enhance propogation.

(5) The reactive energy and sensitivity adding fuels, on detonation, add very significant amounts of heat to the reaction, overcoming the quenching potential of invading water, as well as entraining stable air in the mixture.

(6) The solid carbonaceous fuels retain their physical disposition throughout the wetted portions, retain their reactivity and aid in effective detonation.

(7) The inert hydrophobic solids may absorb and hold water, retain fine air bubbles on their surfaces or within, or in the case of micro-spheres, supply a captive additional amount of stable air internally. Being hydrophobic and largely interstitial, these materials physically block or slow water penetration in an ANFO composition, and add to the "hot spots" sensitization of the wetted areas.

In our additive compound the ingredients in addition to the guar flour, all blend together well, to allow a uniform mix. This aids in creating even coating and distribution of our additive throughout the ANFO component when making a blasting composition. The additive ingredients also are compatible and do not interfere with the cross-linkers in use. Generally solid carbonaceous fuels and inerts will be limited to only a few percent of the overall blasting composition. It has been found that the addition of from 1 to 20 percent by weight of energy and sensitivity adding fuels will add proportionately to the strength, wet sensitivity and often velocity of an explosive reaction. With increasing amounts of sensitizers, lesser amounts of the more expensive guar flours may be employed without sacrificing reliability of the explosive reaction. In such formulations, water penetration into the explosive mass would normally be greater, but the additional sensitizers will drive the detonation through these water wetted sections of a column. Economics therefore often may be the deciding factor in replacing some of the guar gum with sensitizers. In large diameter drill holes, formulations with larger amounts of sensitizers can be used at significant cost savings, as critical diameters are larger.

The water thickening agents may also be varied, interchanged or intermixed, often to advantage.

Polyacrylamides, in particular, have been found quite suitable and either alone or in admixture with the flour can add substantially to the desired physical characteristics of gels formed at water contact areas in drill holes. The polyacrylamides also respond to some of the same cross-linkers as guar gums, and can thereby be co-bonded with the guar gum in the cross-linking of wetted areas to further enhance the water barrier thus formed. The polyacrylamide found most suitable has a molecular weight of 1 to 15 million and especially in the 3 to 8 million range, hydrolizes to the extent of from about 11 to 25 percent, has a pH of from 6 to 8 in a 1 percent solution in water, and a Brookfield viscosity in a 1 percent water solution of about 4500 cps. This polyacrylamide may be used effectively over the range of 0.3 to 5 percent of the total blasting composition. Again, as with the guar gums, a high percentage of finer mesh sizes is preferred for coverage and uniformity of distribution.

Generally there is a direct relationship between the amount of guar gum, polyacrylamide and other water thickening agents in the blasting composition and the amount of water resistance and stability that the composition attains. Other facts enter in, however, such as the ammonium nitrate prill size distribution, the water thickener particle size and rate of hydration, the percentage and size distribution of the other constituents, quantity and type of liquid organic fuel, and the amount and type of cross-linker. Assuming other factors in an acceptable range of parameters, an increase in guar gum will result in an increased water resistance. Normally in light to medium water conditions 1 to 3 percent of guar gum is sufficient, while in more severe conditions 4.0 percent and even highter amounts may be required.

Generally the cost of high quality guar flours and polyacrylamides is from 3 to 15 times the cost of the other ingredients of our additive. Since our additive composition allows flexibility of formulation to a user's site conditions, cost may be regulated to advantages. In mild or static water conditions, or with large bore holes, higher energy and sensitivity fuel additive levels can be substituted for part of the water thickening and cross-linking agents as an effective cost saving tool. Such increases in energy and sensitivity fuel additive levels are accompanied by an increase in heat of reaction and velocity of detonation at all water contents, up to and including the saturated condition of over 20 percent of water.

The adhesion or binding of guar gum particles and other additive components to ammonium nitrate prills, plays an important role in my invention. It is very desirable to develop an even coating of the additive materials over the entire surface of the prills, with the excess additive only relegated to the interstitial spaces between the prills. Guar gum will not well adhere to ammonium nitrate prills without the use of some sort of binding agent. It has been found that fuel oil of an ANFO composition is admirable for this purpose, although other liquid organic fuels may also be used to advantage. These fuels may also serve as sensitizers, when selected from the group comprising hydrocarbon fuel oil, nitroparaffins, alcohols, polyhydric alcohols, and suitable mineral and vegetable oils. Usually 1 to 6 percent of such materials is appropriate, depending on the oxygen balance required, with 2.5 to 3.5 of −3.45 oxygen value diesel fuel oil being preferred, or equivalent amounts of the other cited fuels, depending on their respective oxygen values. Only a moistening of the ammonium nitrate prill surface is necessary as larger amounts of the fuel will be absorbed by the porous prills and be not available as a binder. Excessive liquid fuel or excessively tacky fuels that do not absorb well, will tend to make the surfaces too wet, will soak the additives preferentially to the prills, and will result in excessive coating of the prill surfaces, with little material in the interstices and an overall lower density of the final blasting composition. Some of the hydrophobic solid fuels may also be soluble in the liquid fuels and detract from the free flowing and handling characteristics of the blasting agent, as they then tend to become tacky.

Solid carbonaceous fuels add several desirable qualities to our additive. They are ideally strongly hydrophobic, of fine particle size, have the capability of retaining air bubbles on their surfaces in wet environments and are efficient fuels to aid the ANFO reaction. When ANFO is subjected to water and the prills dissolve, contained fuel oil is released, tends to float upward, and to separate from the ammonium nitrate. Solid fuels do not show this tendency to migrate and separate out, so that they are positionally more stable. They also retain their effective reactivity in a wet environment, and at the same time tend to retain entrapped air as bubbles on their surfaces to provide sensitivity to detonation and propogation of the wetted areas of blasting compositions. Being water insoluble these solid fuels also aid in physically blocking water penetration through prill interstices. Another important aspect of the use of such fuel additives is to make the water resistant compositions more free flowing and pourable, as they tend to keep the mixes dry and non-tacky. Such fuels are the least expensive constituents of the basting composition. These materials are typified by finely ground coals, particularly higher quality coals, petroleum cokes, graphites, charcoals and ground wood products. Hard waxes, asphaltic residues, natural waxes, natural resins, gilsonite, and the like may also be suitable, but are more or less soluble in liquid fuels. In fuel wetted formulations they tend to make tacky mixes and can detract from the free flowing characteristic desired.

As indicated, the additive compositions of our invention can vary from light to very substantial water resistance, depending on the water thickener content and degree of cross-linking. More importantly, the energy and sensitivity additives impart the ability for water wet sections to detonate effectively in conjunction with gel formation. These additives also impart explosive strengths varying from that of typical ANFO to the increased strength of metalized ANFO blasting agents, depending on the additive. Detonation velocities of our additive and ANFO compositions are generally faster than ANFO alone, when using the same ammonium nitrate prill, granulation, bore hole diameter and confinement. Because water content of ANFO mixtures with our additive is accidental, depending on the concentration and rate of flow of water, the density may vary locally in a drill hole from 0.80 to 1.25 gms/cc. Water resistant blasting agents formulated from compositions of our invention may contain 45 to 95 percent ammonium nitrate prills, 1.5 to 9 percent liquid organic fuels, 0 to 40 percent soldium nitrate, calcium nitrate or a combination of both, from 1 to 10 percent water thickener, 0.005 to 1 percent of cross-linker, 1 to 20 percent energy and sensitivity additives, 0 to 5 percent solid carbonaceous fuels, and 0 to 5 percent inert solids. Water content supplied by the drill hole or other environmental conditions may vary accidentally from 0 to 30 percent in actual use. Preferred compositions of our invention contain from 60 to 90 percent ammonium nitrate, 2.5 to 6 percent liquid organic fuels, 0 to 20 percent sodium nitrate, calcium nitrate or both, 1 to 5 percent guar gum flour, 0.005 to 0.5 percent cross-liner, 2.5 to 12 percent energy and sensitivity additives, 0.8 to 3 percent solid carbonaceous fuels and 0.3 to 1.5 percent inert solids. Oxygen balance of the preferred compositions is between +5.0 and −18.0, with formulations for underground use being oxygen balanced.

The composition of our invention offers advantages not attainable with prior art blasting agents and explosives. ANFO blasting compositions formed with our additive have all of the physical handling advantages of ANFO, while offering in addition, water resistance and wet sensitivity. They can be efficiently manufactured with existing ANFO mixing equipment with only minor modifications, particularly if the additive is used as a simple one step addition to ANFO. The additive may be pre-packaged, can be precisely formulated and quality controlled, tailored to meet site conditions, and allows easy field mixing by non-expert personnel. The components are relatively inexpensive, and extend the economy of ANFO blasting agents to wet use conditions where they could not previously be used. Our compositions offer full explosive-bore hole coupling and provide a range of dry explosive densities from 0.80 to 1.10 gm/cc, densities not achievable by cartridged ANFO blasting agents. Our admixed ANFO blasting composition may be used to fill bore hole spaces around ANFO cartridges to give the cartridges effective full bore hole coupling and insulate them from water penetration. Both cartridged and sleeved ANFO loads may fail to detonate if the encasing plastic is torn or punctured in the loading process but with our additive in these same applications a water leak will be sealed off internally and the charge will reliably detonate. Our compositions can be readily made to be fully oxygen balanced for use in wet underground conditions, and blow load well in horizontal drill hole applications. Our compositions may also be used to effectively seal off the top of dynamite and slurry bottom-loads, so that ANFO can be used in the upper dry areas of the hole. Blasting compositions with our additives are less sensitive than ordinary ANFO explosives of prior commerce, as they contain no high explosive sensitizers, and thereby provide greater safety in storage, handling and transportation. Our additive is non-explosive and self-extinguishing in a fire, and may be shipped by common carrier. When the additive is mixed with ANFO made at a blast site, the necessity and hazard of transporting explosives is largely eliminated.

EXAMPLES

The following examples are representative of the wide variety and range of blasting agent compositions made possible by our invention. In the following Table I all figures are percentages of the total weight of any single final blasting composition. Column 1 is for comparison with a standard ANFO made from the same prill manufacturer lot as the illustrated compositions with our additive. Column 2 is an effective water blocking composition, in which, however, the wetted areas lack the required sensitivity enhancement and will not detonate efficiently or reliably, even though a gelled periphery develops.

TABLE I

TESTED COMPOSITIONS

| Item | Example 1 | 2 | 3 | 4 | 5 | 6 | 7 |
|---|---|---|---|---|---|---|---|
| ANFO | | | | | | | |
| AN Prills | 94.60 | 88.50 | 87.50 | 74.50 | 87.00 | 80.00 | 87.00 |
| Diesel Fuel Oil | 5.40 | 3.50 | 3.00 | 3.00 | 3.00 | 2.50 | 3.00 |
| $NaNO_3$ or $Ca(NO_3)_2$ | 0 | 0 | 0 | 11.50 | 0 | 7.50 | 0 |
| ADDITIVE | | | | | | | |
| Guar Flour | 0 | 7.80 | 2.00 | 3.00 | 2.00 | 5.00 | 2.00 |
| $Na_2B_4O_7$ | 0 | 0.20 | 0.15 | 0.20 | 0.20 | 0.16 | 0.10 |
| Aluminum | 0 | 0 | 6.00 | 7.30 | 3.50 | 0 | 0 |
| Sulfur | 0 | 0 | 0 | 0 | 3.50 | 3.00 | 6.00 |
| Fine Coal | 0 | 0 | 1.35 | 0 | 0.80 | 1.84 | 1.40 |
| Perlite | 0 | 0 | 0 | 0.50 | 0 | 0 | 0.50 |
| MIXTURE COMPOSITION | | | | | | | |
| % ANFO | 100.0 | 92.0 | 90.5 | 89.0 | 90.0 | 90.0 | 90.0 |
| % Additive | 0 | 8.0 | 9.5 | 11.0 | 10.0 | 10.0 | 10.0 |
| CHARACTERISTICS | | | | | | | |
| Oxygen Balance | 0.00 | −2.72 | −4.16 | +0.25 | −.398 | −2.68 | −5.07 |
| 3" Velocity, feet/sec. | 7306 | 8684 | 9633 | 9372 | 9267 | 7657 | 8187 |
| Density (dry) | 0.86 | 0.81 | 0.85 | 0.90 | 0.84 | 0.84 | 0.82 |
| ADDITIVE COMPOSITION | | | | | | | |
| Guar Flour | 0 | 97.50 | 21.05 | 27.27 | 20.00 | 50.00 | 20.00 |
| $Na_2B_4O_7$ | 0 | 2.50 | 1.58 | 1.82 | 2.00 | 1.60 | 1.00 |
| Aluminum | 0 | 0 | 63.16 | 66.36 | 35.00 | 0 | 0 |
| Sulfur | 0 | 0 | 0 | 0 | 35.00 | 30.00 | 60.00 |
| Fine Coal | 0 | 0 | 14.21 | 0 | 8.00 | 18.40 | 14.00 |
| Perlite | 0 | 0 | 0 | 4.55 | 0 | 0 | 5.00 |

Raw materials used in the mixes were as follows: ammonium nitrate prills were a commercial, industrial grade, pourous prill produced for blasting. Diesel fuel oil was a standard fuel grade. Sodium nitrate prills used were a domestic commercial product. Guar flour was a high quality commercial product, having a high percentage of particles passing a 200 mesh standard sieve screen, and about 12 percent moisture content. The borax used was a commercial dehydrated product with about 50 percent retained on a 30 mesh standard sieve screen. The aluminum used was a medium atomized granular commercial product with about 60 percent passing a 40 mesh standard sieve screen and being retained on a similar 100 mesh screen. The sulfur used was a standard commercial grade of sulfur flours with 99.5 percent passing through 200 mesh standard sieve screen. Coal was a ground anthracite, 80 percent passing a 100 mesh standard sieve screen. Perlie used was a commercial grade of agglomerated micro spheres. The velocity of detonation was measured in 3" diameter plastic pipe using a ¾ pound dynamite primer.

In a specially designed mixing plant facility, these formulas could be made in a step by step fashion, adding the ingredients and mixing each in sequence to obtain a well mixed final product. This would not be possible in conventional ANFO mixing equipment, and not possible at all in on site mixing operations. Using our additive compositions, a superior mix is accomplished in a simple one step fashion. The ANFO (and optional metal nitrates) would be mixed in standard ANFO mixing equipment with the diesel fuel oil (or other fuel), followed by the simple addition of the premixed additive, from an additive hopper or dispenser, to the ANFO mixing system. This can be easily accomplished in either plant or field mixing equipment and either by batch or continuous methods.

A water resistance test was performed on all samples by leaving an unloaded section on top of the containing pipe to which water was added. Water added to example #1 of ANFO penetrated freely and quickly, and the column sank as the ANFO readily dissolved. On the same test on examples #2 through #7, the water penetrated about ¼ inch on top and sealed off, so that the remainder of the water stood on top of the samples. There was some further penetration locally down along the side walls of the pipe, up to several inches. On later emptying of the contents, this peripheral channeling layer was found to be about ¼ to ½ inch thick, and water did not penetrate any further into the column so that most of the composition remained dry. The cross-linked gel thus formed was rubbery and sufficiently coherent that it could be picked up on a pencil. It contained from 19 to 28 percent water and showed undissolved prills in the gelled and cross-linked matrix. In no instance was there any slumping or settling of the column of blasting composition in examples #2 through #7.

The ingredients of example #7 were made into an additive for field testing. The final blasting composition was made at a quarry site in a standard portable cement mixer, by first adding the ammonium nitrate prills and diesel fuel oil to make up 90 percent of the mix, followed after a few minutes of mixing by the pre-mixed additive for the other 10 percent of the composition. Mixing continued a few minutes until a uniform mixture was formed. The resulting blasting composition was bagged in 50 pound bags and loaded in bore holes the next day. The holes were 4.0 inches in diameter, 40 feet deep and arrayed in an 8 foot by 13 foot pattern in dolomite rock. Water conditions were bad enough that the holes were normally sleeved with double polyethylene liners and loaded with ANFO after each hole was drilled and before it could fill with water. Refilling of the hole with water normally took 3 to 5 minutes. Our blasting composition was loaded in the same conditions without sleeving, top and bottom primed and shot at the end of a shift so that some of the holes had been wet for 8 hours. All holes detonated well, breakage was superior to sleeved ANFO, and it was found practical to spread the hole pattern to 9 feet by 14 feet in subsequent blasts with similar composition.

The range of variance of various components for operative reactions of our invention has been explored. Exemplary operable mixtures through the variance range are set forth in the following Table II. Some of these mixtures may be more efficient of operation than others according to the principles hereinbefore set forth.

TABLE II

| Percent | TYPICAL MIXTURES | | | | | | | | | | | | |
|---|---|---|---|---|---|---|---|---|---|---|---|---|---|
| | Total Composition | | | | | | | | Additive Composition | | | | |
| Additive | AN | S/CN | DFO | G | S | Al | C | I | G | S | Al | C | I |
| 5% | 91 | 0 | 4 | 1 | 3 | 1 | 0 | 0 | 20 | 60 | 20 | 0 | 0 |
| | 91 | 0 | 4 | 2 | 2 | 1 | 0 | 0 | 40 | 40 | 20 | 0 | 0 |
| | 91 | 0 | 4 | 3 | 1 | 1 | 0 | 0 | 60 | 20 | 20 | 0 | 0 |
| | 91 | 0 | 4 | 4 | 0 | 1 | 0 | 0 | 80 | 0 | 20 | 0 | 0 |
| | 91 | 0 | 4 | 4.5 | 0 | 0.5 | 0 | 0 | 90 | 0 | 10 | 0 | 0 |
| 7½% | 89.5 | 0 | 3 | 1 | 6.0 | 0 | 0.5 | 0 | 13.3 | 80 | 0 | 6.7 | 0 |
| | 89.5 | 0 | 3 | 2 | 4.5 | 0 | 1 | 0 | 26.7 | 60 | 0 | 13.3 | 0 |
| | 89.5 | 0 | 3 | 3 | 3.5 | 1 | 0 | 0 | 40 | 46.7 | 13.3 | 0 | 0 |
| | 89.5 | 0 | 3 | 4 | 2.5 | 1 | 0 | 0 | 53.3 | 33.3 | 13.3 | 0 | 6.7 |
| | 89.5 | 0 | 3 | 5 | 1.5 | 1 | 0 | 0 | 66.7 | 20 | 13.3 | 0 | 0 |
| 10% | 87 | 0 | 3 | 1 | 8 | 0 | 1 | 0 | 10 | 80 | 0 | 10 | 0 |
| | 87 | 0 | 3 | 2 | 7 | 0 | 1 | 0 | 20 | 70 | 0 | 10 | 0 |
| | 87 | 0 | 3 | 2 | 5.5 | 0 | 2.5 | 0 | 20 | 55 | 0 | 25 | 0 |
| | 87 | 0 | 3 | 3 | 6 | 0 | 1 | 0 | 30 | 60 | 0 | 10 | 0 |
| | 87 | 0 | 3 | 4 | 5 | 0 | 1 | 0 | 40 | 50 | 0 | 10 | 0 |
| | 87 | 0 | 3 | 5 | 4 | 0 | 0.5 | 0.5 | 50 | 40 | 0 | 5 | 5 |
| | 87 | 0 | 3 | 6 | 2.5 | 0 | 0.5 | 0 | 60 | 25 | 0 | 5 | 0 |
| 15% | 81.5 | 0 | 3.5 | 0 | 13 | 0 | 0 | 0 | 0 | 86.7 | 0 | 0 | 0 |
| | 81.5 | 0 | 3.5 | 1 | 12 | 0 | 1 | 1 | 6.7 | 80 | 0 | 6.2 | 6.7 |
| | 81.5 | 0 | 3.5 | 2 | 10 | 0 | 2 | 1 | 13.3 | 66.7 | 0 | 13.3 | 6.7 |
| | 81.5 | 0 | 3.5 | 3 | 8 | 0 | 3 | 1 | 20 | 53.3 | 0 | 20 | 6.7 |
| | 81.5 | 0 | 3.5 | 4 | 10 | 0 | 0 | 1 | 26.7 | 66.7 | 0 | 0 | 6.7 |
| | 81.5 | 0 | 3.5 | 5 | 9 | 0 | 1 | 0 | 33.3 | 60 | 0 | 6.7 | 0 |
| 20% | 77 | 0 | 3 | 1 | 18 | 0 | 0.5 | 0.5 | 5 | 90 | 0 | 2.5 | 2.5 |
| | 77 | 0 | 3 | 2 | 16 | 0 | 1 | 1 | 10 | 80 | 0 | 5 | 5 |
| | 77 | 0 | 3 | 3 | 14 | 0 | 1.5 | 1.5 | 15 | 70 | 0 | 7.5 | 7.5 |
| | 77 | 0 | 3 | 4 | 13 | 0 | 2 | 1 | 20 | 65 | 0 | 10 | 5 |
| | 77 | 0 | 3 | 4 | 11 | 0 | 5 | 0 | 20 | 55 | 0 | 25 | 0 |
| | 77 | 0 | 3 | 5 | 12 | 0 | 2.5 | 0.5 | 25 | 60 | 0 | 12.5 | 2.5 |
| | 77 | 0 | 3 | 6 | 11 | 0 | 1 | 2 | 30 | 55 | 0 | 5 | 10 |
| 10% | 82 | 5 | 3 | 1 | 8 | 0 | 0.5 | 0.5 | 10 | 80 | 0 | 5 | 5 |
| | 77 | 10 | 3 | 2 | 7 | 0 | 1 | 0 | 20 | 70 | 0 | 10 | 0 |
| | 72 | 15 | 3 | 3 | 6 | 0 | 0 | 1 | 30 | 60 | 0 | 0 | 10 |
| | 67 | 20 | 3 | 4 | 5 | 0 | 1 | 0 | 40 | 50 | 0 | 10 | 0 |
| | 62 | 25 | 3 | 5 | 5 | 0 | 0 | 0 | 50 | 50 | 0 | 0 | 0 |
| | 57 | 30 | 3 | 6 | 4 | 0 | 0 | 0 | 60 | 40 | 0 | 0 | 0 |
| | 52 | 35 | 3 | 7 | 3 | 0 | 0 | 0 | 70 | 30 | 0 | 0 | 0 |

NB: Cross-linkers are not shown but may be used in ranges of .005–10%
*Additive abreviations (percentage by weight):
AN — Ammonium Nitrate
S/CN — Sodium & Calcium nitrates
DFO — Diesel Fuel Oil
G — Guar Gum
S — Sulfur
C — Carbon
I — Inert
Al — Aluminum The foregoing description of our invention is necessarily of a detailed nature so that specific embodiments might be set forth as required, but it is to be understood that various modifications of detail, rearrangement of procedures and their ordering, and modifications and substitutions of ingredients may be resorted to without departing from its spirit, essence or scope.

Having thusly described our invention, what we desire to protect by Letters Patent, and what we claim is:

1. A dry, non-explosive particulated additive for an ammonium nitrate and fuel oil explosive composition, to allow use of such composition in wet environs, comprising in combination, by dry weight portion of the additive composition:

Particulated dry gelling agent: 5–90%,
cross-linking agent: 0.025–9%,
energy and sensitivity additives: 10–90%,
particulated solid carbonaceous fuels: 0–25%,
inert hydrophobic solids: 0–10%.

2. The additive of claim 1 wherein the particulated gelling agent is chosen from the group comprising guar gum, polyacrylamides, polyacrylonitriles, and combinations thereof.

3. The invention of claim 1 wherein the cross-linking agent is chosen from the group comprising sodium tetraborate, potassium antimony tartrate, potassium pyroantimonate, tannic acid, salts of chromatic acid and salts of arsenic acid.

4. The invention of claim 1 wherein the energy and sensitivity additives are finely particulated and selected from a group comprising aluminum; aluminum flouride, sodium aluminum fluoride, and magnesium fluoride each in combination with sulfur; ferrosilicon; and sulfur.

5. The invention of claim 1 wherein the particulated solid carbonaceous fuels are chosen from a group comprising coal, petroleum coke, charcoal, graphite, wood, hard waxes and resins.

6. The invention of claim 1 wherein the inert hydrophobic solids are selected from the group comprising perlite and diatomaceous earth.

7. The invention of claim 1 combined in the proportion of from 5 to 20 percent by weight with an ammonium nitrate and fuel oil blasting composition to allow the use of the admixed product in wet environs.

8. A dry particulated blasting composition for use in wet environs, comprising in combination, by dry weight portion of the total composition:

ammonium nitrate prills, soldium nitrate, calcium nitrate, and combinations thereof: 45–81%, liquid organic fuels: 1.5–less than 4%, Additive of claim 1: 5–11%.

9. The additive of claim 8 wherein the particulated gelling agent is chosen from the group comprising guar gum polyacrylamides, polyacrylonitrile and combinations thereof.

10. The invention of claim 8 wherein the cross-linking agent is chosen from the group comprising sodium tetraborate, potassium antimony tartrate, potassium pyroantimonate, tannic acid, salts of chromatic acid and salts of arsenic acid, and combinations thereof.

11. The invention of claim 8 wherein the energy and wet sensitivity additives are finely particulated and selected from a group comprising finely particulated aluminum; aluminum fluoroide, soldium aluminum fluoride, and magnesium fluoride each in combination with sulfur; ferrosilicon; and sulfur.

12. The invention of claim 8 wherein the particulated solid carbonaceous fuels are chosen from a group comprising coal, petroleum coke, charcoal, graphite, wood, hard waxes and resins.

13. The invention of claim 8 wherein the liquid organic fuels are chosen from the group comprising fuel oils, nitroparaffins, alcohols, and polyhydric alcohols.

14. The invention of claim 8 wherein the inert hydrophobic solids are selected from the group comprising perlite and diatomaceous earth.

* * * * *